US006989795B2

(12) United States Patent
Edward et al.

(10) Patent No.: US 6,989,795 B2
(45) Date of Patent: Jan. 24, 2006

(54) LINE-REPLACEABLE TRANSMIT/RECEIVE UNIT FOR MULTI-BAND ACTIVE ARRAYS

(75) Inventors: Brian J. Edward, Jamesville, NY (US); John M. Marziale, Jamesville, NY (US); Peter J. Ruzicka, Auburn, NY (US)

(73) Assignee: Sensis Corporation, East Syracuse, NY (US)

( * ) Notice: Subject to any disclaimer, the term of this patent is extended or adjusted under 35 U.S.C. 154(b) by 5 days.

(21) Appl. No.: 10/897,450

(22) Filed: Jul. 23, 2004

(65) Prior Publication Data

US 2005/0253770 A1 Nov. 17, 2005

Related U.S. Application Data

(60) Provisional application No. 60/571,710, filed on May 17, 2004.

(51) Int. Cl.
*H01Q 1/00* (2006.01)
*H01Q 13/10* (2006.01)
*H01Q 21/00* (2006.01)

(52) U.S. Cl. ..... 343/725; 343/771; 343/720

(58) Field of Classification Search ..... 343/771, 343/720, 725, 727
See application file for complete search history.

(56) References Cited

U.S. PATENT DOCUMENTS 3,623,111 A 11/1971 Provencher et al. ..... 343/727
4,063,248 A * 12/1977 Debski et al. ..... 343/727
5,160,936 A 11/1992 Braun et al. ..... 343/725

* cited by examiner

*Primary Examiner*—Wilson Lee
*Assistant Examiner*—Angela M Lie
(74) *Attorney, Agent, or Firm*—Burr & Brown

(57) ABSTRACT

A line-replaceable unit for a phased array antenna including a thermally conductive housing having a front face and an opposed rear face, at least one open-ended waveguide extending through the housing from the front face to the rear face, at least one first radiating element including the waveguide and adapted to emit energy in a first frequency band; and at least one second radiating element positioned on the front face of the housing and adapted to emit energy in a second frequency band distinct from the first frequency band. The waveguide is dimensioned to pass energy in the first frequency band and is exposed to the environment outside the housing at the front and rear faces to define a cooling duct passing through the housing.

38 Claims, 8 Drawing Sheets

LINE-REPLACEABLE TRANSMIT/RECEIVE UNIT FOR MULTI-BAND ACTIVE ARRAYS

CROSS REFERENCE TO RELATED APPLICATION

This application claims the benefit under 35 U.S.C. § 119(e) of U.S. Provisional Application Ser. No. 60/571,710, filed May 17, 2004, the entirety of which is incorporated herein by reference.

FEDERAL RESEARCH STATEMENT

This invention was made with government support under M67854-04-C-2004 awarded by the United States Marine Corps. The government has certain rights in the invention.

FIELD OF THE INVENTION

The present invention generally relates to array antenna systems, and more particularly, line-replaceable transmit/receive units for multi-band active phased array systems with forced air cooling.

BACKGROUND OF THE INVENTION

Next generation radar systems will be required to perform multiple missions and deliver higher levels of performance, while being readily integrated into their host platforms. Providing the ability for the radar system to operate in more than a single frequency band enables realizing optimum multi-mission performance. For example, lower operating frequencies generally provide superior long range surveillance capabilities particularly when the detrimental effects of weather are considered. In contrast, higher operating frequencies, with their associated narrower antenna beamwidths and wider available instantaneous bandwidth waveforms, excel for angular accuracy and target discrimination.

To support these multiple missions with high levels of operational flexibility and overall performance, next generation radars will also need to employ active phased array antenna systems. Phased arrays are configured from a multitude of individual radiating elements whose phase and amplitude states can be electronically controlled. The radiated energy from the collection of elements combines constructively (focused) so as to form a beam. The angular position of the beam is electronically redirected by controlling the elements' phases. Controlling both the elements' phases and amplitudes alters the shape of the beam. Each individual radiator of an active phased array antenna includes an initial low noise amplifier for receive mode and a final power amplifier for transmit mode, in addition to the phase and amplitude control circuitry.

Juxtaposing multiple single-band array antennas to achieve operation in more than a single frequency band is incompatible with platform limitations, particularly from a size viewpoint. Consequently, the multiple band coverage must be derived from a single antenna system. Previous attempts to do so have comprised performance. Phased arrays have been designed to provide operation on widely separating frequencies by using a common radiating element for the multiple bands. These designs exhibit low efficiencies at the lower operating frequency and lose full control of the beam at the upper frequency extreme. Most of these conventional phased arrays are also passive in that they do not include receive and transmit amplifiers with each radiating element.

Dual frequency active arrays have been demonstrated where the frequency bands are contiguous. The array radiating elements and their associated electronics attempt to cover the full frequency range. The drawback with these designs is that the amplifiers exhibit non-optimum performance due to their necessity to cover an extended bandwidth. Additionally, the quantity of elements and electronics is denser than what would generally be required for the lower frequency band, which leads to the array being heavier, having higher heat densities, and being too costly.

Most host platform limitations, especially mobile platforms, necessitate that the radar system be assembled with light weight, small volume components and structures. Highly reliable operation with ease of maintenance and component replacement is also required. In addition, the inclusion of active components will require an effective thermal management system, preferably using air to minimize cooling system power consumption and to maximize reliability. To date, no such radar systems are available.

SUMMARY OF THE INVENTION

It is an object of the present invention to overcome the problems of the prior art by providing a compact, lightweight line-replaceable transmit/receive (T/R) unit for assembling active phased array antenna systems that provide operation in two distinct frequency bands. The line-replaceable T/R unit in accordance with the present invention integrates the radiating elements and their transmit/receive electronics plus the associated DC power supply and control circuitry into a compact, lightweight modular building block for assembling multi-band active phased arrays. The units are constructed using light weight materials having favorable thermal properties. The line-replaceable T/R unit employs air cooling to convectively remove heat from the active electronics where the radiating element waveguide design for one operating frequency band also serves as an air coolant passage. The line-replaceable T/R unit is designed to plug into an array structure, in a manner that promotes ready access for service or replacement as required. This approach also facilitates system growth by either increasing the array size through additional line-replaceable T/R units or by upgrading the line-replaceable T/R units with, for example, higher power transmit amplifiers. The line-replaceable T/R unit is described herein in the context of a dual-band application where the line-replaceable T/R units, when assembled into an antenna array structure, form an active phased array antenna capable of operating on two distinct frequency bands with uncompromised performance.

In accordance with one embodiment of the invention, a line-replaceable T/R unit is provided for a phased array antenna, the unit comprising a thermally conductive housing having a front face and an opposed rear face, at least one open-ended waveguide extending through the housing from the front face to the rear face, at least one first radiating element including the waveguide and adapted to emit energy in a first frequency band, and at least one second radiating element positioned on the front face of the housing and adapted to emit energy in a second frequency band distinct from the first frequency band. The waveguide is dimensioned to pass energy in the first frequency band and is exposed to the environment outside the housing at the front and rear faces to define a cooling duct passing through the housing.

In accordance with another embodiment of the invention, a line-replaceable T/R unit is provided for a phased array antenna, the unit comprising a housing having a front face and an opposed rear face, at least one open-ended waveguide dimensioned to pass energy in a first frequency band extending through the housing from the front face to the rear face, at least one first radiating element including the waveguide and adapted to emit energy in the first frequency band, and at least two second radiating elements positioned on the front face of the housing and adapted to emit energy in a second frequency band distinct from the first frequency band.

In accordance with yet another embodiment of the invention, a line-replaceable T/R unit is provided for a phased array antenna, the unit comprising a housing having a front face and an opposed rear face, at least one open-ended waveguide dimensioned to pass energy in a first frequency band and attenuate energy in a second frequency band extending through the housing from the front face to the rear face, at least one first radiating element including the waveguide and adapted to emit energy in the first frequency band, and at least two second radiating elements positioned on the front face of the housing adjacent to the waveguide and adapted to emit energy in the second frequency band. The radiated electric field polarization direction of the first radiating element is arranged orthogonal to the radiated electric field polarization direction of the second radiating elements.

In accordance with another embodiment of the invention there is provided a phased array antenna comprising a plurality of line-replaceable T/R units. Each line-replaceable T/R unit comprises a thermally conductive housing having a front face and an opposed rear face, at least one open-ended waveguide extending through the housing from the front face to the rear face, at least one first radiating element including the waveguide and adapted to emit energy in a first frequency band, and at least one second radiating element positioned on the front face of the housing and adapted to emit energy in a second frequency band distinct from the first frequency band. The waveguide is dimensioned to pass energy in the first frequency band and is exposed to the environment outside the housing at the front and rear faces to define a cooling duct passing through the housing.

In accordance with another embodiment of the invention, there is provided a phased array antenna comprising a plurality of line-replaceable T/R units. Each line-replaceable T/R unit comprises a housing having a front face and an opposed rear face, at least one open-ended waveguide dimensioned to pass energy in a first frequency band extending through the housing from the front face to the rear face, at least one first radiating element including the waveguide and adapted to emit energy in the first frequency band, and at least two second radiating elements positioned on the front face of the housing and adapted to emit energy in a second frequency band distinct from the first frequency band.

In accordance with another embodiment of the invention, there is provided a phased array antenna comprising a plurality of line-replaceable T/R units. Each line-replaceable T/R unit comprises a housing having a front face and an opposed rear face, at least one open-ended waveguide dimensioned to pass energy in a first frequency band and attenuate energy in a second frequency band extending through the housing from the front face to the rear face, at least one first radiating element including the waveguide and adapted to emit energy in the first frequency band, and at least two second radiating elements positioned on the front face of the housing adjacent to the waveguide and adapted to emit energy in the second frequency band. The radiated electric field polarization direction of the first radiating element is arranged orthogonal to the radiated electric field polarization direction of the second radiating elements.

BRIEF DESCRIPTION OF THE DRAWINGS

For a fully understanding of the nature and objects of the invention, reference should be made to the following detailed description of a preferred mode of practicing the invention, read in connection with the accompanying drawings in which.

DETAILED DESCRIPTION OF THE INVENTION

Figure 1A:
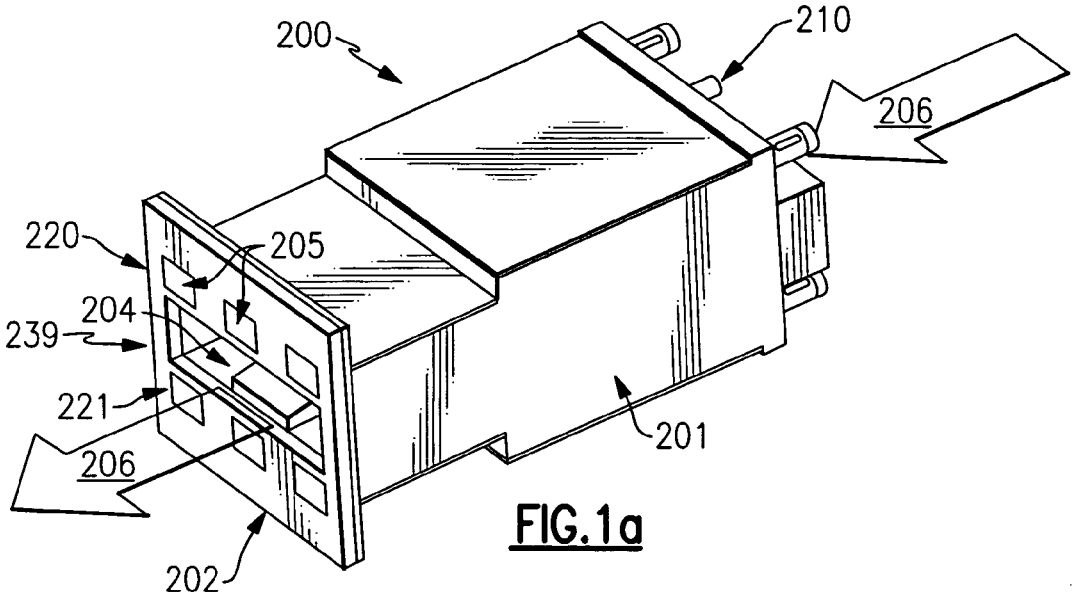
FIG. 1*a* is a perspective front view of a line-replaceable T/R unit for a phased array antenna in accordance with an embodiment of the present invention.
Figure 1B:
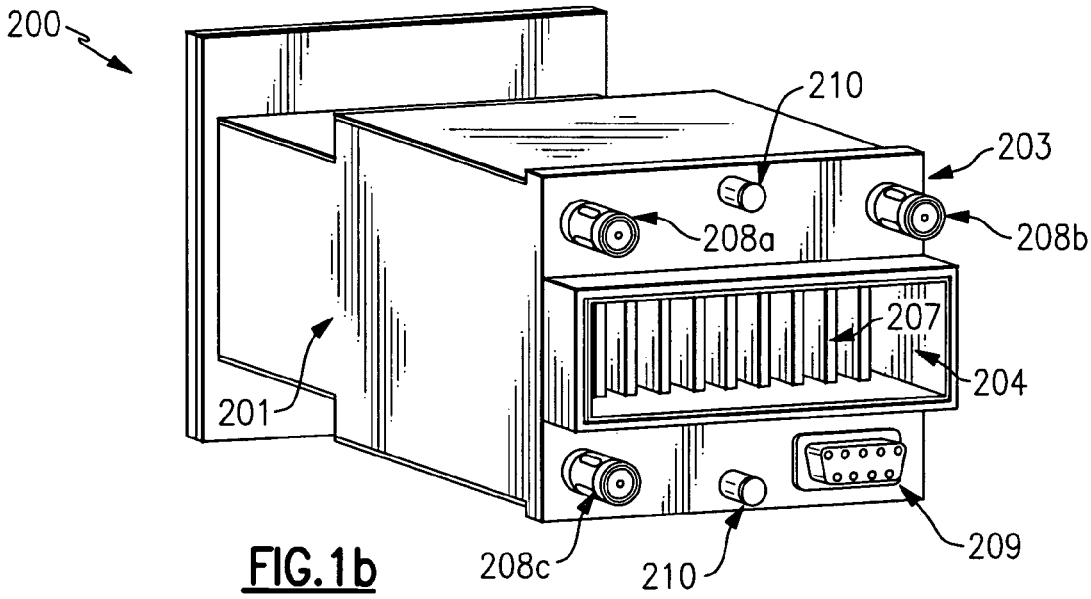
FIG. 1*b* is a perspective rear view of the line-replaceable T/R unit shown in FIG. 1*a;*
Figure 2A:
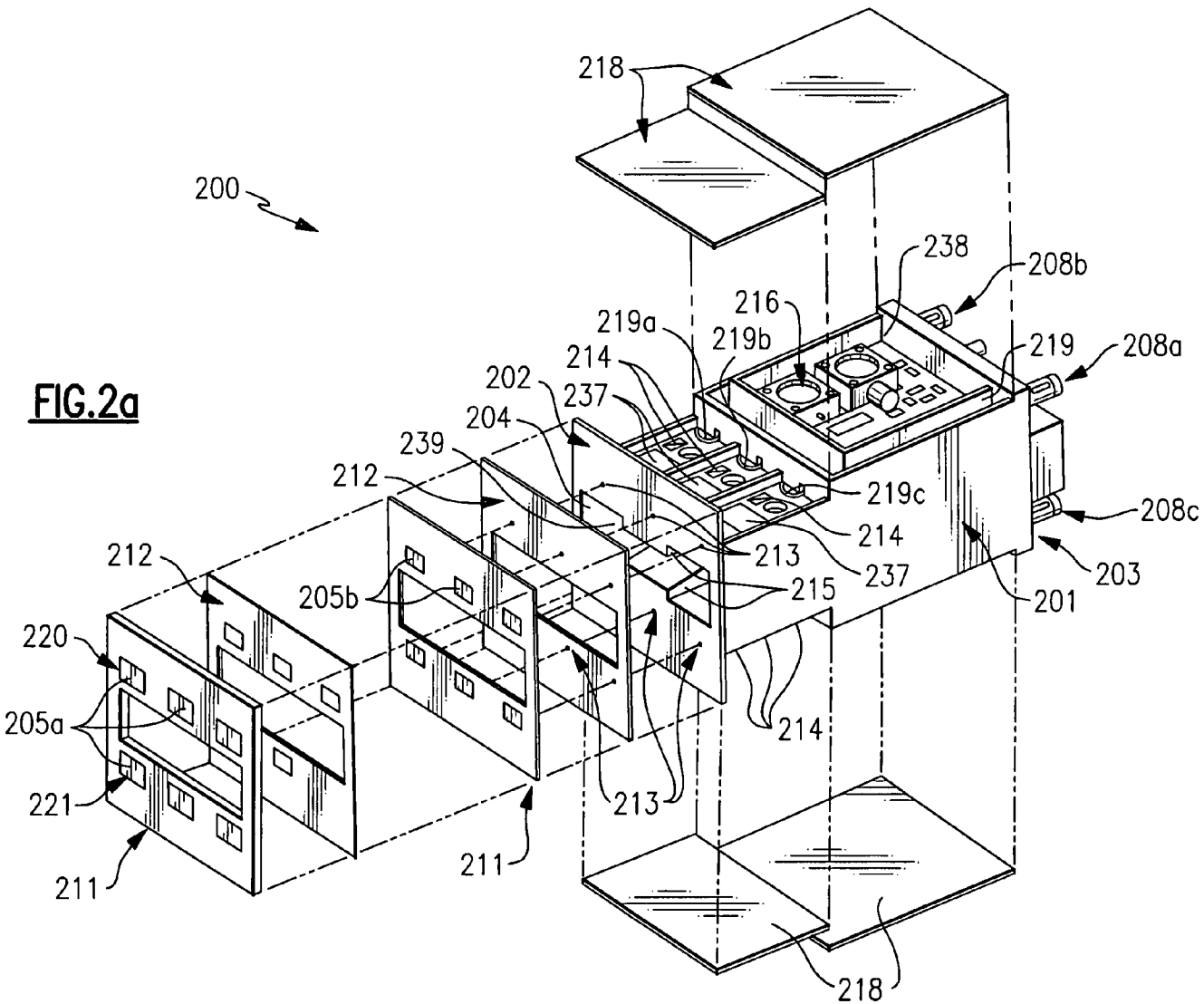
FIG. 2*a* is an exploded perspective view of the line-replaceable T/R unit shown in FIGS. 1*a* and 1*b;*
Figure 2B:
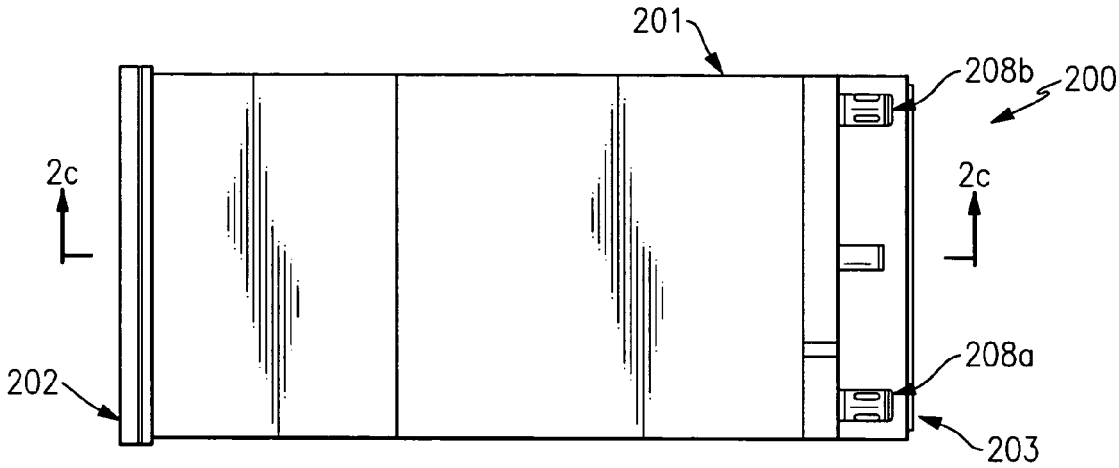
FIG. 2*b* is a top view of the line-replaceable T/R unit shown in FIGS. 1*a*–2*a;*
Figure 2C:
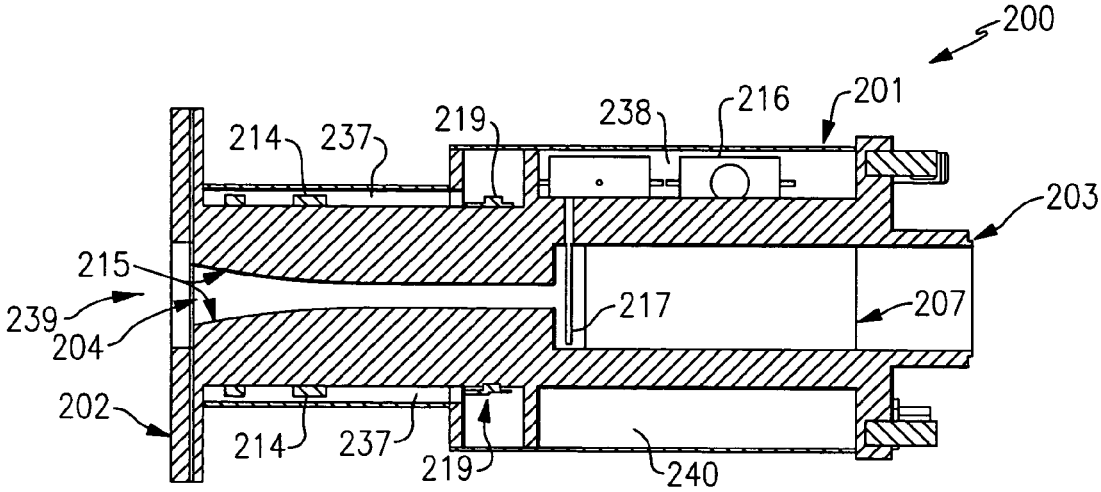
FIG. 2*c* is a cross-sectional view of the line-replaceable T/R unit taken through line 2*c*–2*c* of FIG. 2*b;*
Figure 2E:
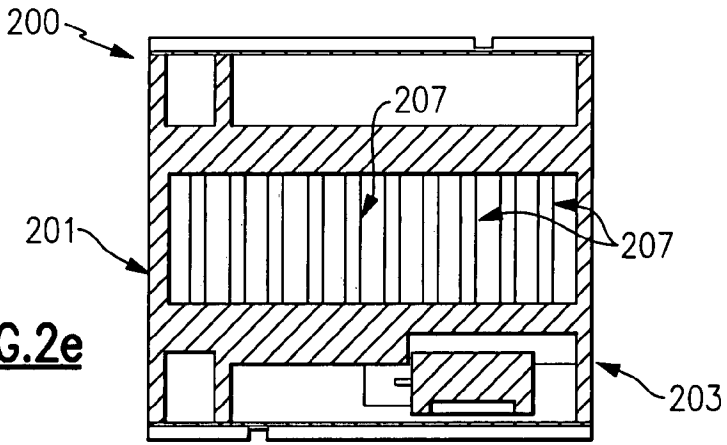
FIG. 2*e* is a cross-sectional view of the line-replaceable T/R unit taken through line 2*e*—2*e* of FIG. 2*d;*
Figure 2F:
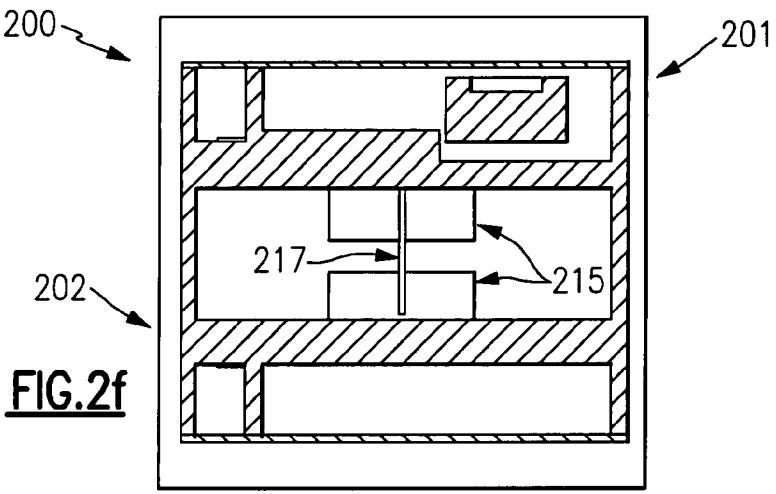
FIG. 2*f* is a cross-sectional view of the line-replaceable T/R unit taken through line 2*f*—2*f* of FIG. 2*d;*
Figure 2D:
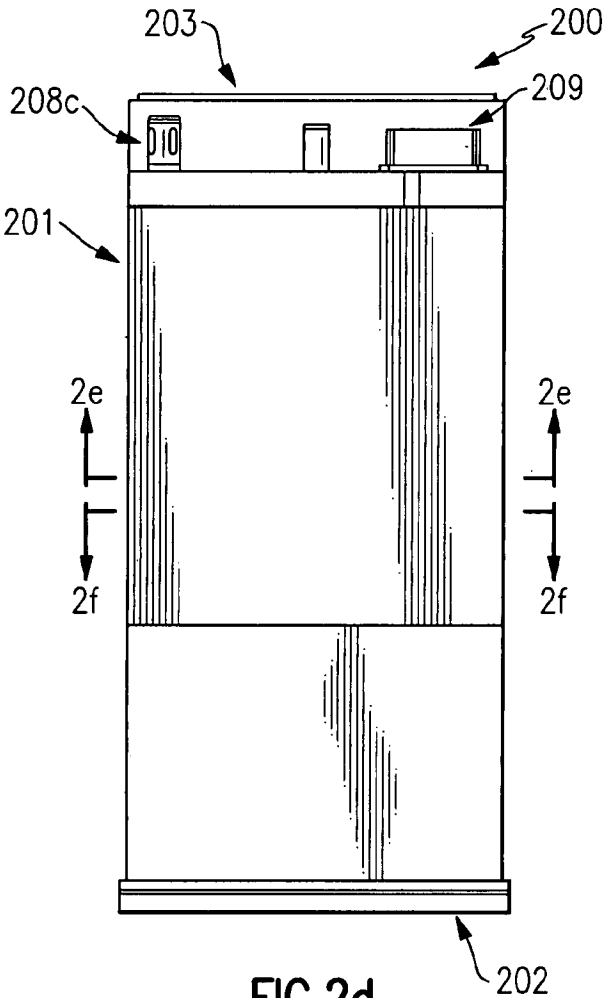
FIG. 2*d* is a bottom view of the line-replaceable T/R unit shown in FIGS. 1*a*–2*c;*

One embodiment of the present invention will now be explained with reference to FIG. 1*a* and FIG. 1*b*. FIG. 1*a* is a perspective front view and FIG. 1*b* is a perspective rear view of a line-replaceable transmit/receive (T/R) unit for a phased array antenna in accordance with one embodiment of the present invention. The housing 201 of line-replaceable T/R unit 200 is fabricated as a one-piece, net-shape casting, for example, which requires minimal, if any, machining and provides thin cross-sections resulting in a low overall weight. Housing 201 can be made from a variety of well-known materials, one example of which is a metal matrix composite, preferably Aluminum Silicon Carbide (AlSiC). AlSiC has a high thermal conductivity to promote heat extraction from heat producing components, and has a thermal coefficient of expansion well matched to the typical component materials, which results in reduced stresses during temperature cycling. Additionally, AlSiC is electrically conductive and contributes to a low overall weight and can be plated to facilitate direct solder attachment of the high heat generating components.

First radiating element 239 includes open-ended waveguide 204 which extends fully from the approximate center of rear face 203 to the approximate center of front face 202 of line-replaceable T/R unit 200. Waveguide 204 of first radiating element 239 is preferably dimensioned to pass energy in a first frequency band and attenuate energy in a second frequency band. In other words, one dimension of the open-ended waveguide 204 of first radiating element 239, for example width, is dimensioned to pass energy in a first frequency band and a second dimension of open-ended waveguide 204, for example height, is dimensioned to attenuate energy in a second frequency band.

Second radiating elements 205 are positioned in a plane parallel to front face 202 in an upper row 220 and a lower row 221 on the front face 202 of housing 201. Second radiating elements 205 are formed as printed microstrip patch radiators to emit energy in a second selected frequency band. The microstrip patch radiators are flush to front face 202 of housing 201 to minimize system volume requirements and may be directly connected to the transmit/receive electronics via simple coaxial interfaces as will be described later in more detail.

It is preferred that the ratio of the operating frequencies between the two frequency bands is at least 3 to 1. By way of example only, the first frequency band is selected to be S-band and the second frequency band is selected to be X-band. However, the invention is not limited to these frequency bands. In the present embodiment, one dimension of open-ended waveguide 204, for example width, is dimensioned to pass energy in the S-band (nominally 3 GHz) and a second dimension of open ended waveguide 204, for example height, is dimensioned to attenuate energy in at least the X-band (nominally 10 GHz). Therefore the height of the open-ended S-band waveguide 204 is dimensioned such that its electrical length is less than one-half of the wavelength of the highest X-band frequency and the width of the open-ended S-band waveguide 204 is dimensioned such that its electrical length is greater than one-half of the wavelength of the lowest S-band frequency.

Open-ended waveguide 204 of first radiating element 239 is exposed to the environment outside the housing at the front 202 and rear 203 faces of housing 201. In accordance with a preferred embodiment, coolant air 206 is ducted through open-ended waveguide 204 from rear face 203 to front face 202 to effectively extract heat from the active T/R components within the housing. Vertical conductive slats 207 act as cooling fins to facilitate the heat transfer from the active T/R components to the coolant air 206, and further act as an electrical short for the operation of the S-band radiating element 239 as will be described later in more detail.

DC connector 209 and plunge-style Radio Frequency (RF) connectors 208*a–c* facilitate mating of the line-replaceable T/R unit 200 to an antenna array system's RF manifolds and DC/control distribution networks when the line-replaceable T/R unit 200 is placed into an array. Guide pins 210 properly align and locate the line-replaceable T/R unit 200 when installed in an antenna array.

Referring now to FIGS. 2*a–2f*, front face 202 of housing 201 is formed as a flat panel and functions as a ground plane for the phased array radiating aperture. X-band microstrip patch radiating elements 205 are photo-lithographically printed onto dielectric material 211 that is bonded by an interposed adhesive sheet 212 to the front face 202 of housing 201. A two-layer patch 205*a* and 205*b*, may be employed due to its wide bandwidth properties. Coaxial feed probes 213 penetrate front face 202 so as to directly interconnect each X-band patch radiator 205 with its respective X-band T/R channel circuitry 214.

Open-ended waveguide 204 of S-band radiating element 239 opens at front face 202, between the rows of X-band patch radiators 205. Dielectric material 211, which supports the patches, is removed at the waveguide opening. The bottom and top interior walls of open-ended waveguide 204 of radiating element 239 each have a longitudinal ridge 215, which is smaller in width than open-ended waveguide 204. Longitudinal ridges 215 enable the S-band radiator to operate at lower frequencies for a given interior width and contribute to heat transfer between active components 214, 216 and coolant air as will be discussed later in more detail. Longitudinal ridges 215 are tapered in height from front face 202 to rear face 203 such that the space between longitudinal ridges 215 increases in a direction moving toward front face 202 of housing 201.

Open-ended waveguide 204 is directly coupled to S-band T/R channel circuitry 216 via a coaxial feed probe 217 to complete S-band radiating element 239. Coaxial feed probe 217 is embedded in the upper floor of housing 201 and extends downward into open-ended waveguide 204.

Partitioned areas 237, 238 are formed in the top of housing 201 for the placement of the electronic components for the S-band channel and each of the three top X-band channels. Similar partitioned areas 237, 240 are formed in the bottom of housing 201 for the placement of the electronic components for each of the three bottom X-band channels as well as a DC power supply and controller. The partitions promote electrical isolation and provide energy shielding between the T/R circuits, DC power supply and controller. Cover plates 218 can be laser welded against the top and bottom surfaces of the walls of housing 201 to complete a hermetic package for the components.

RF energy is coupled into and out from line-replaceable T/R unit 200 through RF connectors 208. For example, RF connector 208*a* couples X-band energy into line-replaceable T/R unit 200 for transmission from X-band patch radiators 205 in upper row 220. The X-band energy propagates through signal combining/dividing network 219 formed in housing 201 to X-band T/R channel circuitry 214 for each of the X-band radiator elements 205 in upper row 220. Signal combining/dividing network 219 also performs initial beam forming for the X-band signal. X-band T/R channel circuitry 214 processes the X-band energy in accordance with control signals received via DC connector 209 prior to transmission through coaxial feed probes 213 to X-band radiators 205 on upper row 220 as will be described later in more detail. X-band energy received by X-band radiators 205 on upper row 220 propagates through coaxial feed probes 213 to X-band T/R channel circuitry 214 through signal combining/dividing network 219 and out from line-replaceable T/R unit 200 through RF connector 208*a*. Similarly, X-band energy is coupled into and out from line-replaceable T/R unit 200 through RF connector 208*c* and X-band radiators 205 on bottom row 221.

S-band energy is coupled into S-band T/R channel circuitry 216 of line-replaceable T/R unit 200 through RF connector 208*b*. T/R channel circuitry 216 processes the S-band energy in accordance with control signals received via DC connector 209 prior to transmission through S-band radiating element 239 via coaxial feed probe 217, as will be described later in more detail. As previously discussed, vertical conductive slats 207 act as an electrical short such that S-band energy from coaxial feed probe 217 is transmitted only from front face 202 of line-replaceable T/R unit 200. S-band energy that may propagate toward the rear face 203 of line-replaceable T/R unit 200 is significantly attenuated via vertical conductive slats 207.

S-band energy received by radiating element 239 is coupled into S-band T/R channel circuitry 216 via coaxial feed probe 217 and out of line-replaceable T/R unit 200 through RF connector 208*b*.

Figure 3:
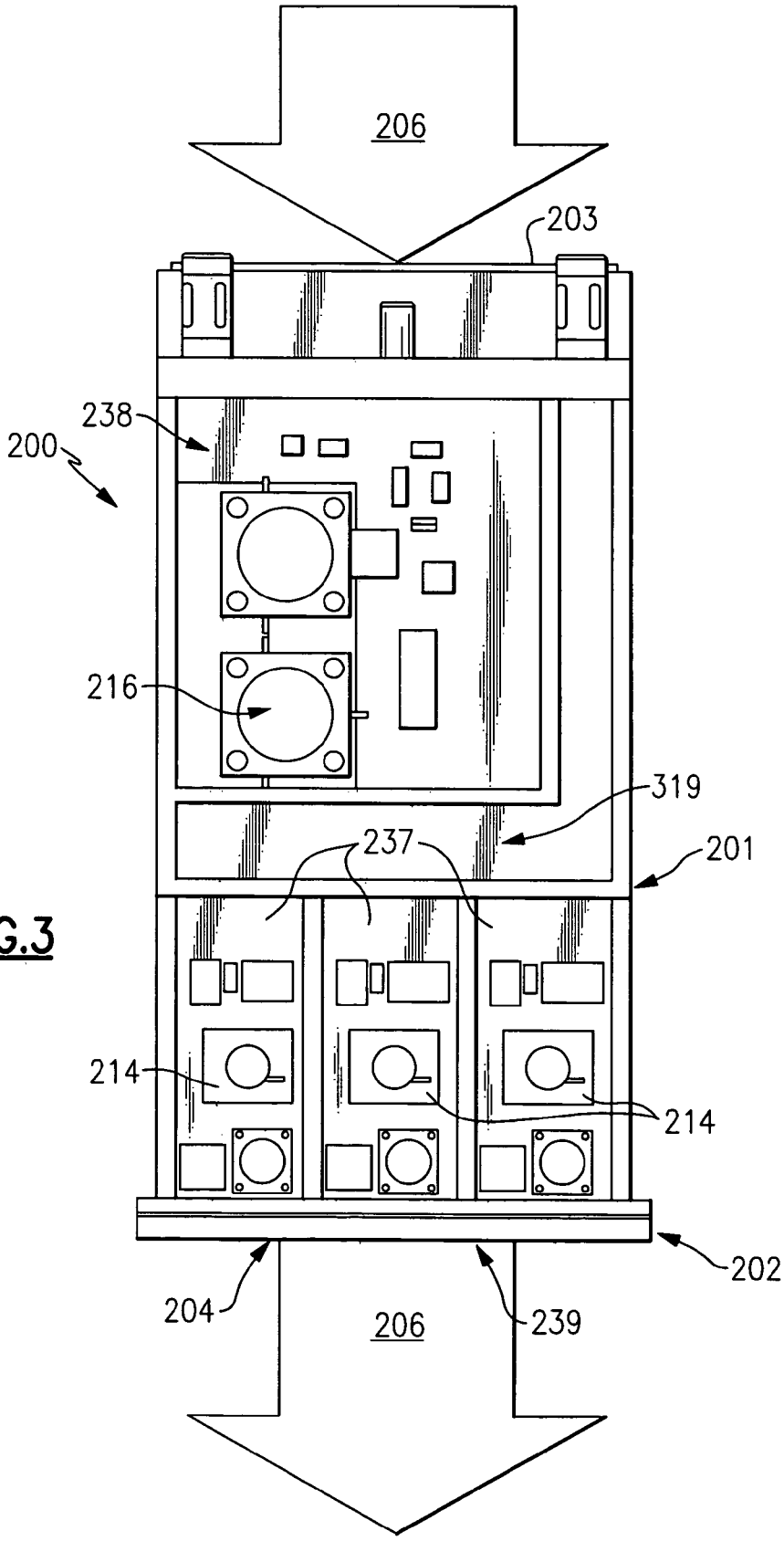
FIG. 3 is a top interior view of the line replaceable T/R unit showing an example of placement of electronic T/R components in accordance with an embodiment of the present invention.

FIG. 3 shows representative layouts of the X-band 214 and S-band 216 T/R channel components within the top partitions of housing 201. High heat generating components of both X-band 214 and S-band 216 T/R channel components are mounted directly to the floor of partitioned areas 237 and 238 of housing 201, which forms part of an upper inner surface of open-ended waveguide 204. As previously discussed, housing 201 is made from a material with high thermal conductivity to promote heat extraction from heat producing components. Additionally, the open-ended waveguide 204 of S-band radiating element 239 extends fully from the rear face 203 to the front face 202 of the line-replaceable T/R unit housing 201 and passes directly beneath all of the active components of the S-band T/R electronics 216 and top row X-band T/R electronics 214. Therefore, coolant air 206, which is ducted through open-ended waveguide 204, effectively extracts heat from active X-band 214 and S-band 216 T/R channel components through conduction from the base of each circuit 214, 216 through the floor of partitioned areas 237 and 238 of housing 201 and convection by the coolant air 206. The thermal impedance of this design is low so that the temperature differential between the air coolant and the active components is limited to acceptable values. Similarly, the open-ended waveguide 204 of the S-band radiating element 239 passes directly over all of the active components 214 of the bottom row of X-band radiators as well as the DC power supply and controller which are mounted directly to the ceiling of the bottom partitioned areas (not shown) of housing 201 which forms part of a lower inner surface of open-ended waveguide 204. As a result the same cooling process occurs with respect to the active components within the bottom partitioned areas of housing 201.

Figure 4:
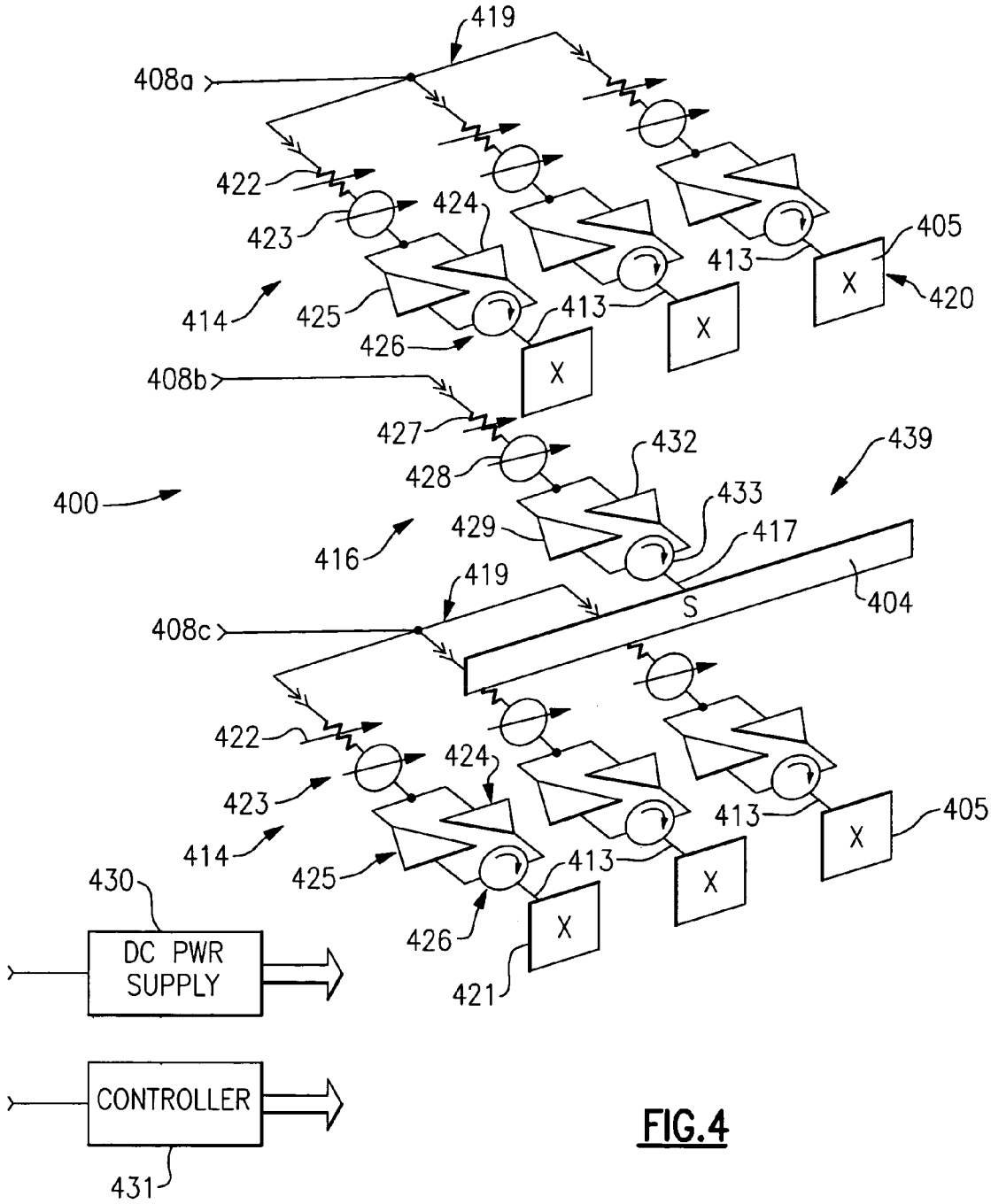
FIG. 4 is a block diagram of the transmit and receive circuitry for a line replaceable T/R unit in accordance with an embodiment of the present invention.

FIG. 4 is a block diagram of the transmit and receive circuitry for a line replaceable T/R unit in accordance with an embodiment of the present invention. The upper row 420 and lower row 421 X-band T/R channel components 414 include RF connectors 408*a* and 408*c*, signal combining/dividing networks 419, X-band amplitude control components 422, X-band phase control components 423, final X-band transmit power amplifiers 424, initial X-band receive low noise amplifiers 425, X-band directional circulators 426, coaxial feed probes 413 and X-band radiators 405. These components are closely located proximate X-band radiators 405 to minimize detrimental signal losses arising from physically long interconnections.

The S-band T/R channel components 416 include RF connector 408*b*, S-band amplitude control components 427, S-band phase control components 428, final S-band transmit power amplifier 432 initial S-band receive low noise amplifier 429, S-band directional circulator 433, coaxial feed probe 417 and open-ended waveguide 404. Again, these components are closely located proximate open-ended waveguide 404 to minimize detrimental signal losses arising from physically long interconnections.

DC power supply 430 and controller 431 are provided in line-replaceable T/R unit 400 for deriving the collection of voltages required for the T/R channel components and for setting the states of the phase and amplitude control components and sequencing transmit/receive operation.

X-band energy coupled into line-replaceable T/R unit 400 via RF connectors 408*a* and 408*c* is divided into separate signals by signal combining/dividing network 419. Each X-band signal is then subject to proper amplitude and phase adjustments by X-band amplitude control components 422 and X-band phase control components 423 for proper beam steering of the transmitted energy based on signals provided from controller 431 as is known in the art. The X-band signals, now of proper phase and amplitude are amplified by final X-band transmit power amplifiers 424, pass through directional circulators 426 and are transmitted out through X-band radiators 405 via coaxial feed probes 413.

X-band signals received through X-band radiators 405 pass through coaxial feed probes 413 and directional circulators 426 and are amplified by initial X-band receive low noise amplifiers 425 to a level where the signals can be phase and amplitude adjusted by X-band phase control components 423 and X-band amplitude control components 422, respectively. The X-band signals are combined by signal combining/dividing network 419 and coupled out from line-replaceable T/R unit 400 via RF connectors 408*a* and 408*c*.

S-band energy coupled into line-replaceable T/R unit 400 via RF connector 408*b* is subject to proper amplitude and phase adjustments by S-band amplitude control components 427 and S-band phase control components 428 for proper beam steering of the transmitted energy based on signals provided from controller 431 as is known in the art. The S-band signals, now of proper phase and amplitude are amplified by final S-band transmit power amplifier 432, pass through directional circulator 433, and are coupled to open-ended waveguide 404 via coaxial feed probe 417 and subsequently transmitted out the front face of line-replaceable T/R unit 400. As previously discussed, vertical conductive slats 207 (FIG. 1*b*) act as an electrical short to prevent S-band energy from exiting the rear face of line-replaceable T/R unit 400.

S-band signals received through open-ended waveguide 404 are coupled out of open-ended waveguide 404 via coaxial feed probe 417 through directional circulator 433 and are amplified by initial S-band receive low noise amplifier 429 to a level where the signals can be phase and amplitude adjusted by S-band phase control components 428 and S-band amplitude control components 427, respectively. The amplified S-band signals are coupled out from line-replaceable T/R unit 400 via RF connector 408*b*. Again, vertical conductive slats 207 (FIG. 1*b*) ensure that no received S-band energy exits open-ended waveguide 404 through the rear face of line-replaceable T/R unit 400.

Figure 5:
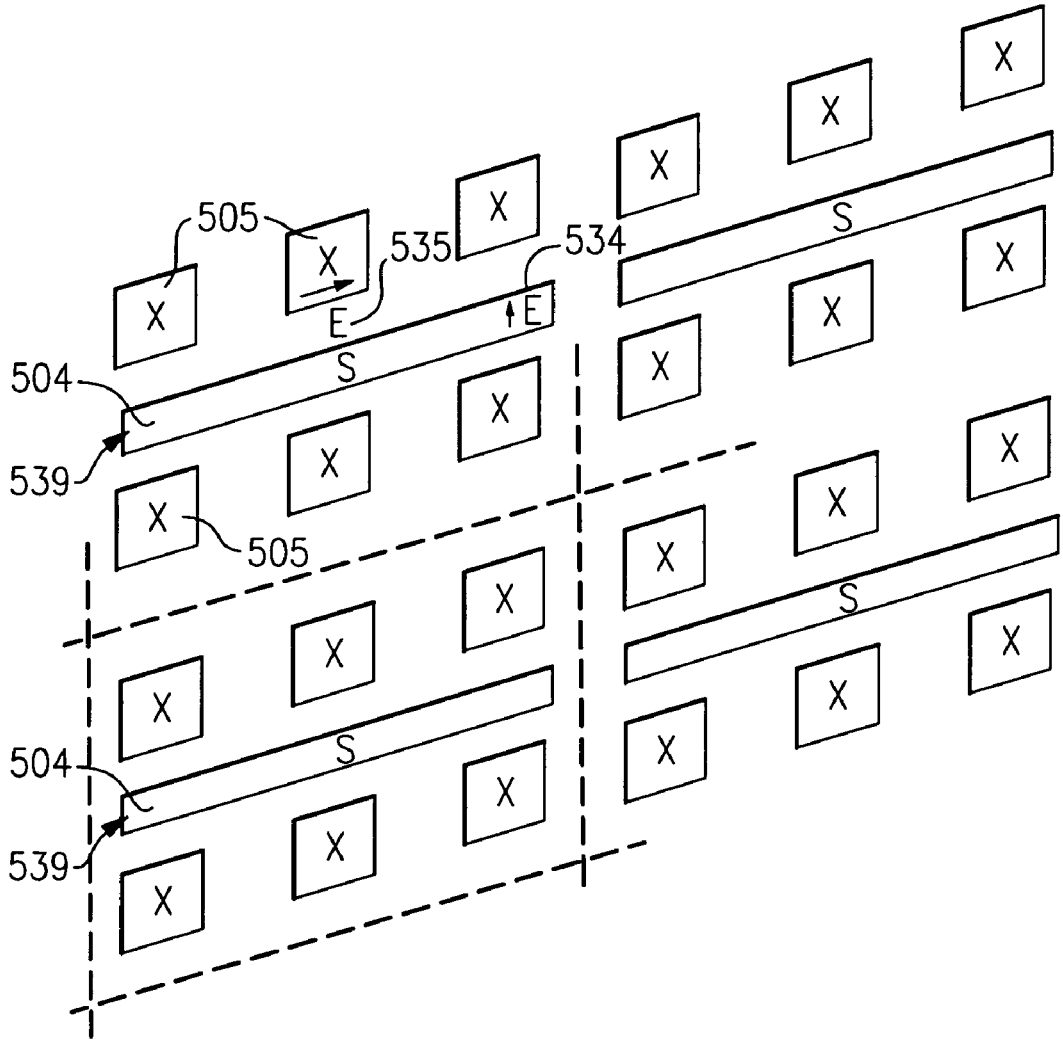
FIG. 5 is a block diagram showing the relationship between two separate frequency band radiators in accordance with an embodiment of the present invention.

FIG. 5 is a block diagram of a portion of a phased array antenna aperture incorporating line-replaceable T/R units in accordance with the present invention showing an interleaving of X-band 505 and S-band 539 radiating elements. The ratio of X-band 505 to S-band 539 radiating elements depicted is six-to-one where two rows of three X-band radiators 505 each are arranged horizontally; one X-band radiator 505 row above the associated S-band radiating element 539 and one X-band radiator 505 row below the associated S-band radiating element 539. The radiating element ratio is dictated by the relationship of the operating frequencies and the phased array beam angular coverage required in each of the bands. The ratio of six-to-one is appropriate for a typical ground-based radar application. The radiated electric field polarization 534 for the S-band radiating element 539 is vertical while the radiated electric field polarization 535 for the X-band radiators 505 is horizontal. The orthogonal orientation of the electric fields 534, 535 promotes isolation of the signals originating from either one of the bands' T/R electronics into the T/R electronics for the other band. In other words, the response of the X-band radiating element 505 to the energy from the S-band radiating element 539 will be significantly lower due to the orthogonal orientation of the electric fields. Further, the height of the S-band waveguide 504 of S-band radiating element 539 is selected so as to effectively "cut-off" the orthogonally polarized X-band electric field. For example, the height of the S-band waveguide 504 is selected such that the electrical length of the height of the waveguide is less than one-half of the wavelength of the highest X-band frequency. This promotes additional isolation of signals between the two bands as is known in the art.

Figure 6:
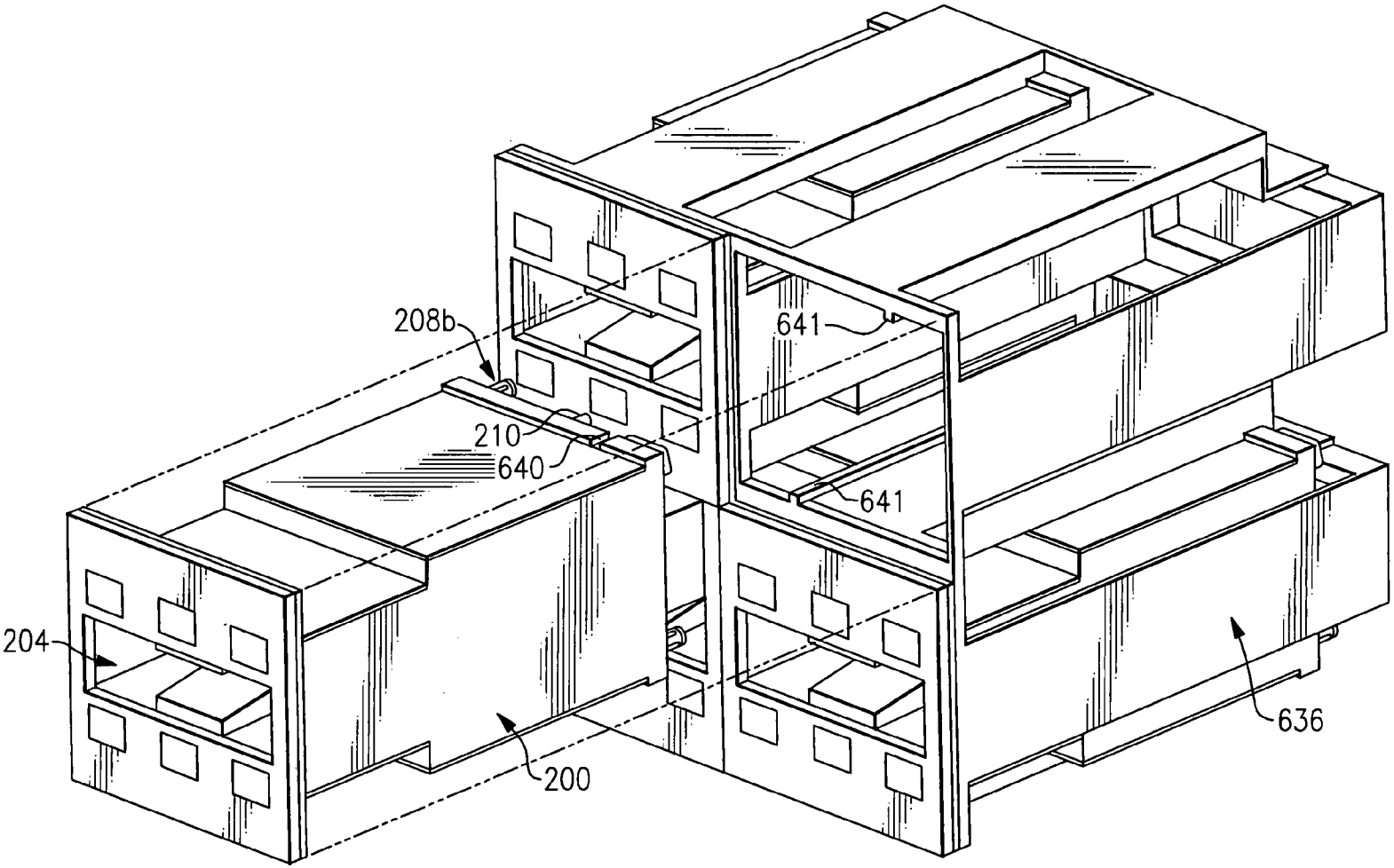
FIG. 6 is a perspective view of a section of a phased array antenna incorporating the line-replaceable T/R unit in accordance with an embodiment of the present invention.

FIG. 6 is a perspective view of a section of a phased array antenna 636 incorporating line-replaceable T/R units 200 in accordance with the present invention. Line replaceable T/R units 200 are guided into antenna array structure 636 by aligning grooves 640 in line replaceable T/R unit 200 with ridges 641 in antenna array structure 636 and sliding line replaceable T/R unit 200 into antenna array structure 636 to engage guide pins 210. As previously discussed, guide pins 210 positively locate and secure the line-replaceable T/R unit 200 in antenna array structure 636. Additionally, guide pins 210 ensure correct alignment of DC connector 209 (FIG. 1*b*) and RF connectors 208*a–c* with mating connectors (not shown) within the antenna array structure. Openings in the antenna array's air supply plenum align to the open-ended waveguide 204 at the rear face of line-replaceable T/R unit 200. A skeletal design for the antenna array structure 636 permits it to be rigid yet light in weight.

It will be understood that various modifications and changes may be made in the present invention by those of ordinary skill in the art who have the benefit of this disclosure. All such changes and modifications fall within the spirit of this invention, the scope of which is measured by the following appended claims.

What is claimed:

1. A line-replaceable unit for a phased array antenna, comprising:

a thermally conductive housing having a front face and an opposed rear face;

at least one open-ended waveguide extending through said housing from said front face to said rear face, said waveguide being dimensioned to pass energy in a first frequency band;

at least one first radiating element including said waveguide and adapted to emit energy in said first frequency band; and at least one second radiating element positioned on said front face of said housing and adapted to emit energy in a second frequency band distinct from said first frequency band;

wherein said waveguide is exposed to the environment outside said housing at said front and rear faces to define a cooling duct passing through said housing.

2. A line-replaceable unit for a phased array antenna according to claim 1, further comprising a heat transfer mechanism defined by internal surfaces of said waveguide.

3. A line-replaceable unit for a phased array antenna according to claim 2, wherein said heat transfer mechanism further comprises cooling fins bridging opposed internal surfaces of said waveguide.

4. A line-replaceable unit for a phased array antenna according to claim 3, wherein said heat transfer mechanism further comprises ridges defined by portions of upper and lower, inner surfaces of said waveguide, said ridges extending from a position proximate a longitudinal middle portion of said housing toward said front face thereof.

5. A line-replaceable unit for a phased array antenna according to claim 3, wherein said cooling fins extend between portions of upper and lower, inner surfaces of said waveguide.

6. A line-replaceable unit for a phased array antenna according to claim 1, wherein said housing further comprises an upper wall that defines at least a part of an upper, inner surface of said waveguide, and a lower wall that defines at least part of a lower, inner surface of said waveguide.

7. A line-replaceable unit for a phased array antenna according to claim 6, further comprising heat-generating electronic components mounted directly on said upper and lower walls.

8. A line-replaceable unit for a phased array antenna according to claim 7, wherein said housing further comprises an upper cover panel that, in cooperation with said upper wall, defines a hermetically sealed upper compartment for housing said electronic components.

9. A line-replaceable unit for a phased array antenna according to claim 8, wherein said housing further comprises a lower cover panel that, in cooperation with said lower wall, defines a hermetically sealed lower compartment for housing said electronic components.

10. A line-replaceable unit for a phased array antenna according to claim 9, further comprising partition members within at least one of said upper and lower compartments to provide energy-shielded partitioned areas within said compartments.

11. A line-replaceable unit for a phased array antenna according to claim 1, wherein said waveguide extends from the approximate center of said front face of said housing to the approximate center of said rear face of said housing.

12. A line-replaceable unit for a phased array antenna according to claim 1, wherein said housing comprises a material that is electrically conductive.

13. A line-replaceable unit for a phased array antenna, comprising:

a housing having a front face and an opposed rear face;

at least one open-ended waveguide extending through said housing from said front face to said rear face, said waveguide being dimensioned to pass energy in a first frequency band;

at least one first radiating element including said waveguide and adapted to emit energy in said first frequency band; and at least two second radiating elements positioned on said front face of said housing and adapted to emit energy in a second frequency band distinct from said first frequency band.

14. A line-replaceable unit for a phased array antenna according to claim 13, wherein said waveguide extends from the approximate center of said front face of said housing to the approximate center of said rear face of said housing, and said second radiating elements are positioned above and below said waveguide.

15. A line-replaceable unit for a phased array antenna according to claim 13, wherein said waveguide has a width dimension, in a plane parallel to said front face, that is electrically at least one-half of the wavelength of the lowest frequency within said first frequency band.

16. A line-replaceable unit for a phased array antenna according to claim 15, wherein said waveguide has a height dimension, in said plane parallel to said front face, that is electrically less than one-half of the wavelength of the highest frequency within said second frequency band.

17. A line-replaceable unit for a phased array antenna according to claim 13, wherein said front face of said housing defines a ground plane for said second radiating elements.

18. A line-replaceable unit for a phased array antenna according to claim 17, wherein each of said second radiating elements comprises a conductive pattern printed onto a dielectric sheet.

19. A line-replaceable unit for a phased array antenna according to claim 18, wherein said dielectric sheet is fixed to said front face of said housing through an interposed adhesive.

20. A line-replaceable unit for a phased array antenna according to claim 13, wherein portions of upper and lower, inner surfaces of said waveguide define ridges extending from a position proximate a longitudinal middle portion of said housing toward said front face thereof.

21. A line-replaceable unit for a phased array antenna according to claim 20, wherein a spacing between said ridges increases in a direction moving toward said front face of said housing.

22. A line-replaceable unit for a phased array antenna according to claim 20, wherein each of said ridges has a width dimension, in a plane parallel to said front face, that is less than a width dimension of said waveguide in said plane.

23. A line-replaceable unit for a phased array antenna according to claim 13, further comprising a mechanism for providing a back-plane electrical short for energy in said first frequency band, said mechanism being positioned within said waveguide proximate said rear face of said housing.

24. A line-replaceable unit for a phased array antenna according to claim 23, wherein said mechanism comprises cooling fins extending between portions of upper and lower, inner surfaces of said waveguide.

25. A line-replaceable unit for a phased array antenna according to claim 13, wherein said second radiating elements are arranged in a plane that is parallel to said front face of said housing.

26. A line-replaceable unit for a phased array antenna, comprising:

a housing having a front face and an opposed rear face;

at least one open-ended waveguide extending through said housing from said front face to said rear face, said waveguide being dimensioned to pass energy in a first frequency band and attenuate energy in a second frequency band distinct from said first frequency band;

at least one first radiating element including said waveguide and adapted to emit energy in said first frequency band; and at least two second radiating elements positioned on said front face of said housing adjacent to said waveguide and adapted to emit energy in said second frequency band;

wherein the radiated electric field polarization direction of said first radiating element is arranged orthogonal to the radiated electric field polarization direction of the said second radiating elements.

27. A line-replaceable unit for a phased array antenna according to claim 26, wherein said second radiating elements are positioned on opposite sides of said waveguide.

28. A line-replaceable unit for a phased array antenna according to claim 26, wherein said waveguide extends from the approximate center of said front face of said housing to the approximate center of said rear face of said housing, and said second radiating elements are positioned above and below said waveguide.

29. A line-replaceable unit for a phased array antenna according to claim 26, wherein said waveguide has a width dimension, in a plane parallel to said front face, that is electrically at least one-half of the wavelength of the lowest frequency within said first frequency band.

30. A line-replaceable unit for a phased array antenna according to claim 29, wherein said waveguide has a height dimension, in said plane parallel to said front face, that is electrically less than one-half of the wavelength of the highest frequency within said second frequency band.

31. A line-replaceable unit for a phased array antenna according to claim 26, wherein portions of upper and lower, inner surfaces of said waveguide define ridges extending from a position proximate a longitudinal middle portion of said housing toward said front face thereof.

32. A line-replaceable unit for a phased array antenna according to claim 31, wherein a spacing between said ridges increases in a direction moving toward said front face of said housing.

33. A line-replaceable unit for a phased array antenna according to claim 31, wherein each of said ridges has a width dimension, in a plane parallel to said front face, that is less than a width dimension of said waveguide in said plane.

34. A line-replaceable unit for a phased array antenna according to claim 26, further comprising a mechanism for providing a back-plane electrical short for energy in said first frequency band, said mechanism being positioned within said waveguide proximate said rear face of said housing.

35. A line-replaceable unit for a phased array antenna according to claim 34, wherein said mechanism comprises cooling fins extending between portions of upper and lower, inner surfaces of said waveguide.

36. A phased array antenna comprising at least one line-replaceable unit, said line-replaceable unit further comprising:

a thermally conductive housing having a front face and an opposed rear face;

at least one open-ended waveguide extending through said housing from said front face to said rear face, said waveguide being dimensioned to pass energy in a first frequency band;

at least one first radiating element including said waveguide and adapted to emit energy in said first frequency band; and at least one second radiating element positioned on said front face of said housing and adapted to emit energy in a second frequency band distinct from said first frequency band;

wherein said waveguide is exposed to the environment outside said housing at said front and rear faces to define a cooling duct passing through said housing.

37. A phased array antenna comprising at least one line-replaceable unit, said line-replaceable unit further comprising:

a housing haying a front face and an opposed rear face;

at least one open-ended waveguide extending through said housing from said front face to said rear face, said waveguide being dimensioned to pass energy in a first frequency band;

at least one first radiating element including said waveguide and adapted to emit energy in said first frequency band; and at least two second radiating elements positioned on said front face of said housing and adapted to emit energy in a second frequency band distinct from said first frequency band.

38. A phased array antenna comprising at least one line-replaceable unit, said line replaceable unit further comprising:

a housing having a front face and an opposed rear face;

at least one open-ended waveguide extending through said housing from said front face to said rear face, said waveguide being dimensioned to pass energy in a first frequency band and attenuate energy in a second frequency band distinct from said first frequency band;

at least one first radiating element including said waveguide and adapted to emit energy in said first frequency band; and at least two second radiating elements positioned on said front face of said housing adjacent to said waveguide and adapted to emit energy in said second frequency band;

wherein the radiated electric field polarization direction of said first radiating element is arranged orthogonal to the radiated electric field polarization direction of the said second radiating elements.

* * * * *

UNITED STATES PATENT AND TRADEMARK OFFICE

CERTIFICATE OF CORRECTION

PATENT NO. : 6,989,795 B2 
DATED : January 24, 2006
INVENTOR(S) : Brian J. Edward, John M. Marziale and Peter J. Ruzicka It is certified that error appears in the above-identified patent and that said Letters Patent is hereby corrected as shown below:

Column 12,
Line 56, change "haying" to -- having --.

Signed and Sealed this

Eighteenth Day of April, 2006

JON W. DUDAS
*Director of the United States Patent and Trademark Office*